US008854288B2

(12) United States Patent
Lin et al.

(10) Patent No.: US 8,854,288 B2
(45) Date of Patent: Oct. 7, 2014

(54) TANGENT ANGLE CIRCUIT IN A LIQUID CRYSTAL DISPLAY DRIVING SYSTEM HAVING A CHARGING AND DISCHARGING MODULE FOR THE SCAN LINE DRIVING CIRCUITS

(75) Inventors: Po-shen Lin, Shenzhen (CN); Xiaoping Tan, Shenzhen (CN); Jianyong Fu, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 343 days.

(21) Appl. No.: 13/380,892

(22) PCT Filed: Sep. 19, 2011

(86) PCT No.: PCT/CN2011/079793

§ 371 (c)(1), (2), (4) Date: Dec. 26, 2011

(87) PCT Pub. No.: WO2013/033926

PCT Pub. Date: Mar. 14, 2013

(65) Prior Publication Data

US 2013/0057461 A1 Mar. 7, 2013

(30) Foreign Application Priority Data

Sep. 6, 2011 (CN) ..... 2011 1 0262778

(51) Int. Cl.
*G09G 3/36* (2006.01)

(52) U.S. Cl.
CPC ..... *G09G 3/36* (2013.01)
USPC ..... 345/94; 345/211

(58) Field of Classification Search
CPC ..... G09G 3/3674; G09G 2310/0202–2310/02
USPC ..... 345/94, 211
See application file for complete search history.

(56) References Cited

U.S. PATENT DOCUMENTS

2008/0036717 A1* 2/2008 Moon ..... 345/87
2009/0066684 A1* 3/2009 Lee ..... 345/211

(Continued)

FOREIGN PATENT DOCUMENTS

CN 101937639 A 1/2011
CN 201716968 U 1/2011
CN 102043274 A 5/2011

OTHER PUBLICATIONS

International Search Report of the PCT Application No. PCT/CN2011/079793.

(Continued)

*Primary Examiner* — Long D Pham

(57) ABSTRACT

A tangent angle circuit is connected to a plurality of scan line driving circuits and comprises: a charging module integrated on a control board to receive input of a direct current (DC) driving voltage and output a cut-in voltage to charge the scan line driving circuits; and a plurality of discharging modules integrated on the scan line driving circuits respectively to control the corresponding scan line driving circuits to discharge. In the present invention, by distributing the discharging modules on each of the scan line driving circuits respectively, the burden of load discharged charges on the discharging modules is reduced to avoid occurrence of an overhigh temperature; and the discharging modules are spatially separated, which is further favorable for reducing the temperature, releasing the space of the control board and reducing the area of the control board.

18 Claims, 5 Drawing Sheets

(56) References Cited

U.S. PATENT DOCUMENTS

| | | | | |
|---|---|---|---|---|
| 2009/0153539 | A1* | 6/2009 | Le et al. | 345/212 |
| 2011/0267326 | A1* | 11/2011 | Kim et al. | 345/211 |
| 2013/0069925 | A1* | 3/2013 | Lin et al. | 345/211 |

OTHER PUBLICATIONS

1st Office Action of Chinese Patent Application No. 201110262778.6 issued by Chinese Patent Office.

* cited by examiner

TANGENT ANGLE CIRCUIT IN A LIQUID CRYSTAL DISPLAY DRIVING SYSTEM HAVING A CHARGING AND DISCHARGING MODULE FOR THE SCAN LINE DRIVING CIRCUITS

BACKGROUND

1. Technical Field

The present invention relates to the field of liquid crystal display (LCD) driving, and more particularly, to a tangent angle circuit in an LCD driving system and the LCD driving system.

2. Description of Related Art

In the LCD driving system architecture, in order to reduce a feedback voltage and the linear variation effect, an LCD driving system must be provided with a tangent angle circuit for regulating a slope of a driving voltage waveform (i.e., for generating a tangent angle). Currently, the tangent angle circuit has been widely applied in all kinds of LCD driving system. Usually, the tangent angle circuit has all of its components installed on a control board of the LCD driving system, and adopts a metal-oxide-semiconductor (MOS) transistor as a switch component to control a cut-in voltage to charge scan line driving circuits. Meanwhile, discharging modules are connected in parallel to a discharge voltage output of the scan line driving circuits. Thus, when the MOS transistor is turned on under the control of a control signal, the scan line driving circuits discharge through the discharging modules so as to transmit charges from a load end of the scan line driving circuits to the ground.

However, when the scan line driving circuits discharge, all the currents flow through the discharging modules. This causes the temperature of the discharging modules to rise gradually, resulting in an overhigh temperature or even burning-down of the discharging modules.)

BRIEF SUMMARY

The primary objective of the present invention is to provide a tangent angle circuit in an LCD driving system which provides a good heat dissipation effect and has a small footprint, and the LCD driving system.

The present invention provides a tangent angle circuit in an LCD driving system, which is connected to a plurality of scan line driving circuits. The tangent angle circuit comprises:

a charging module, being integrated on a control board and configured to receive input of a direct current (DC) driving voltage and output a cut-in voltage to charge the scan line driving circuits; and a plurality of discharging modules, being integrated on the scan line driving circuits respectively and configured to control the corresponding scan line driving circuits to discharge.

Preferably, each of the discharging modules comprises:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharging rate of the discharge voltage.

Preferably, the discharging control sub-module comprises a first metal-oxide-semiconductor (MOS) transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor.

Preferably, the discharging control sub-module further comprises a pull-up) resistor, and the gate of the first MOS transistor is connected to a power source via the pull-up resistor.

Preferably, the charging module comprises:

a switch sub-module, being configured to receive the input of the DC driving voltage and output the cut-in voltage to charge the scan line driving circuits; and a switch control sub-module, being configured to control the switch sub-module to turn on or turn off so as to control a charging time of the scan line driving circuits.

Preferably, the switch control sub-module comprises a second MOS transistor, the switch sub-module comprises a third MOS transistor, the second MOS transistor has a source that is grounded, a gate for receiving a second control signal that controls the second MOS transistor to turn on or turn off, and a drain connected to a gate of the third MOS transistor via a first resistor to control the third MOS transistor to turn on or turn off; a source of the third MOS transistor receives the input of the DC driving voltage, the DC driving voltage is inputted to the gate of the third MOS transistor via a second resistor and is also inputted to a drain of the third MOS transistor via a third resistor, and the drain of the third MOS transistor outputs the cut-in voltage to charge the scan line driving circuits.

Preferably, the switch control sub-module further comprises a pull-down resistor, and the gate of the second MOS transistor is grounded via the pull-down resistor.

Preferably, the second control signal and the first control signal are high-/low-level square waves having a same period but opposite amplitudes.

The present invention further provides another tangent angle circuit in an LCD driving system, which is connected to a plurality of scan line driving circuits. The tangent angle circuit comprises:

a charging module, being integrated on a control board and configured to) receive input of a DC driving voltage and output a cut-in voltage to charge the scan line driving circuits;

a plurality of discharging modules, being integrated on the scan line driving circuits respectively and configured to control the corresponding scan line driving circuits to discharge; and a voltage stabilizing module, being connected to the discharging modules and configured to control a discharge lower limit of the scan line driving circuits.

Preferably, each of the discharging modules comprises:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharging rate of the discharge voltage.

Preferably, the discharging control sub-module comprises a first MOS transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor.

Preferably, the discharging control sub-module further comprises a pull-up resistor, and the gate of the first MOS transistor is connected to a power source via the pull-up resistor.

Preferably, the voltage stabilizing module comprises a voltage-regulator connected in series with the discharge resistor, and the voltage-regulator has a positive electrode connected to the drain of the first MOS transistor and a negative electrode for receiving the input of the discharge voltage via the discharge resistor.

The present invention further provides an LCD driving system, which) comprises a control board and a plurality of scan line driving circuits. The LCD driving system further comprises:

a tangent angle circuit, comprising:

a charging module, being integrated on the control board and configured to receive input of a DC driving voltage and output a cut-in voltage to charge the scan line driving circuits; and a plurality of discharging modules, being integrated on the scan line driving circuits respectively and configured to control the corresponding scan line driving circuits to discharge.

Preferably, each of the discharging modules comprises:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharging rate of the discharge voltage.

Preferably, the discharging control sub-module comprises a first MOS transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor.

Preferably, the discharging control sub-module further comprises a pull-up resistor, and the gate of the first MOS transistor is connected to a power source via the pull-up resistor.

Preferably, the charging module comprises:

a switch sub-module, being configured to receive the input of the DC driving voltage and output the cut-in voltage to charge the scan line driving circuits; and)

a switch control sub-module, being configured to control the switch sub-module to turn on or turn off so as to control a charging time of the scan line driving circuits.

Preferably, the switch control sub-module comprises a second MOS transistor, the switch sub-module comprises a third MOS transistor, the second MOS transistor has a source that is grounded, a gate for receiving a second control signal that controls the second MOS transistor to turn on or turn off of, and a drain connected to a gate of the third MOS transistor via a first resistor to control the third MOS transistor to turn on or turn off; a source of the third MOS transistor receives the input of the DC driving voltage, the DC driving voltage is inputted to the gate of the third MOS transistor via a second resistor and is also inputted to a drain of the third MOS transistor via a third resistor, and the drain of the third MOS transistor outputs the cut-in voltage to charge the scan line driving circuits.

Preferably, the switch control sub-module further comprises a pull-down resistor, and the gate of the second MOS transistor is grounded via the pull-down resistor.

In the present invention, by distributing the discharging modules on each of the scan line driving circuits respectively, the burden of load discharged charges on the discharging modules is reduced to avoid occurrence of an overhigh temperature; and because the discharging modules are spatially separated, congestion of components and occupation of space on the control board are avoided, which is further favorable for reducing the temperature, releasing the space of the control board and reducing the area of the control board.

Hereinafter, implementations, functional features and advantages of the present invention will be further described with reference to embodiments thereof and the attached drawings.

DETAILED DESCRIPTION

It shall be understood that, the embodiments described herein are only intended to illustrate but not to limit the present invention.)

Figure 1:
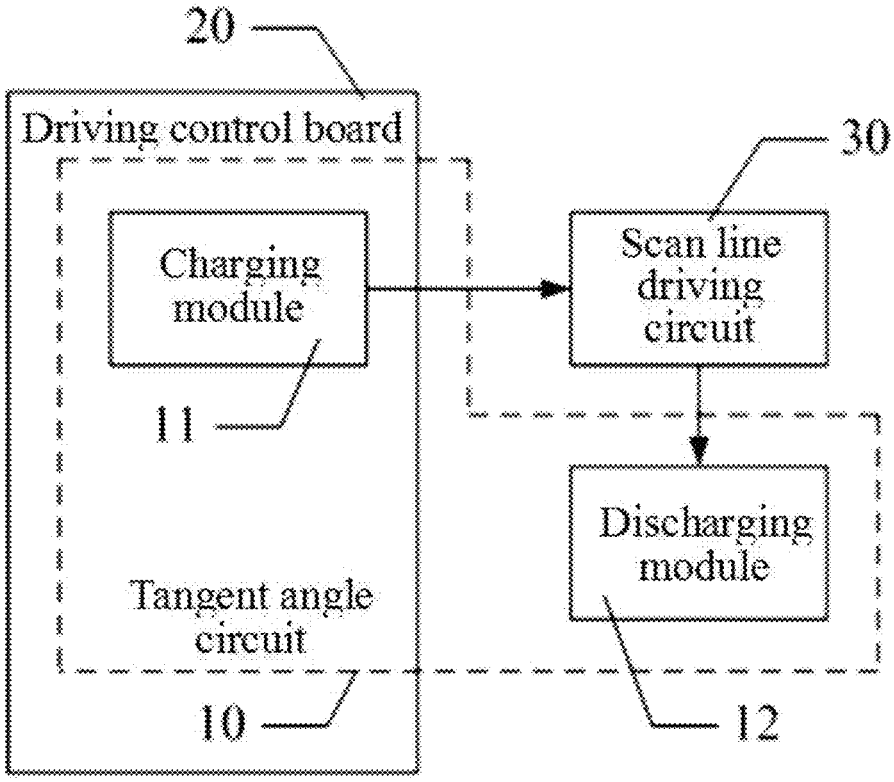
FIG. 1 is a schematic structural view of a tangent angle circuit in an LCD driving system according to the present invention.

As shown in FIG. 1, a tangent angle circuit 10 in a liquid crystal display (LCD) driving system according to an embodiment of the present invention is connected to a plurality of scan line driving circuits 30 and comprises:

a charging module 11, being integrated on a control board 20 and configured to receive input of a direct current (DC) driving voltage and output a cut-in voltage to charge the scan line driving circuits 30; and a plurality of discharging modules 12, being integrated on the scan line driving circuits 30 respectively and configured to control the corresponding scan line driving circuits 30 to discharge.

In this embodiment, there may be a plurality of discharging modules 12 for controlling the scan line driving circuits 30 to discharge; and hereinbelow, this embodiment will be illustrated by taking only one of the discharging modules 12 as an example. Each of the discharging modules 12 is connected to one of the scan line driving circuits 30 respectively so that the burden of load discharged charges on the discharging module 12 is reduced and the discharging module 12 only needs to discharge load charges of the scan line driving circuit 30 to which it corresponds. This can avoid the problem of an overhigh temperature that would occur when the discharging module 12 has to discharge all the load discharged charges, and significantly improve the problem of the overhigh temperature in case of a large-size panel or a high updating frequency. Furthermore, the discharging modules 12 are distributed on the scan lines respectively and are spatially separated, so congestion of components and occupation of space on the control board 20 are avoided, which is further favorable for reducing the temperature, releasing the space of the control board 20 and reducing the area of the control board 20.

Figure 2:
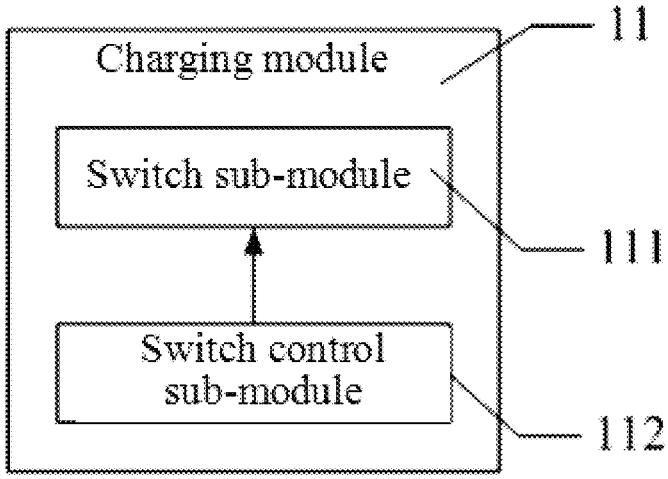
FIG. 2 is a schematic structural view of a charging module of the tangent angle) circuit in the LCD driving system according to the present invention.
Figure 3:
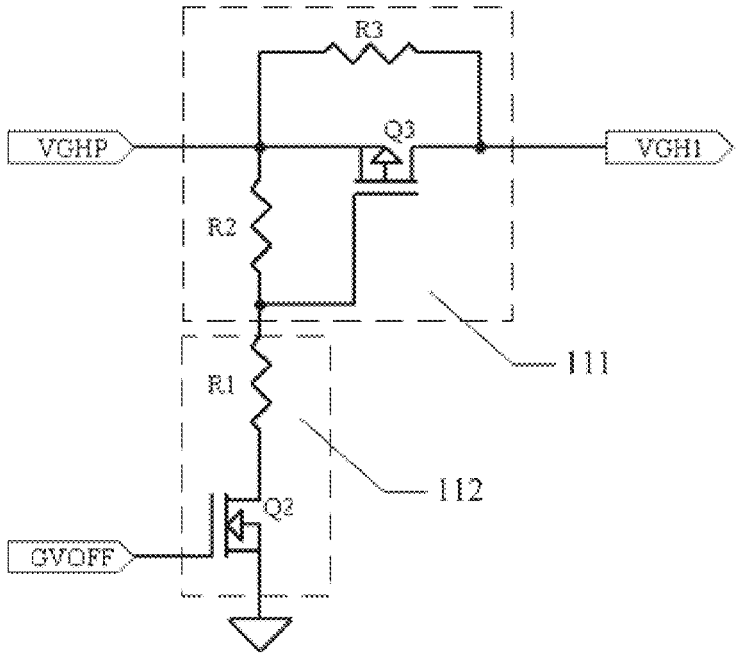
FIG. 3 is a circuit diagram of the charging module of the tangent angle circuit in the LCD driving system according to the present invention.
Figure 4:
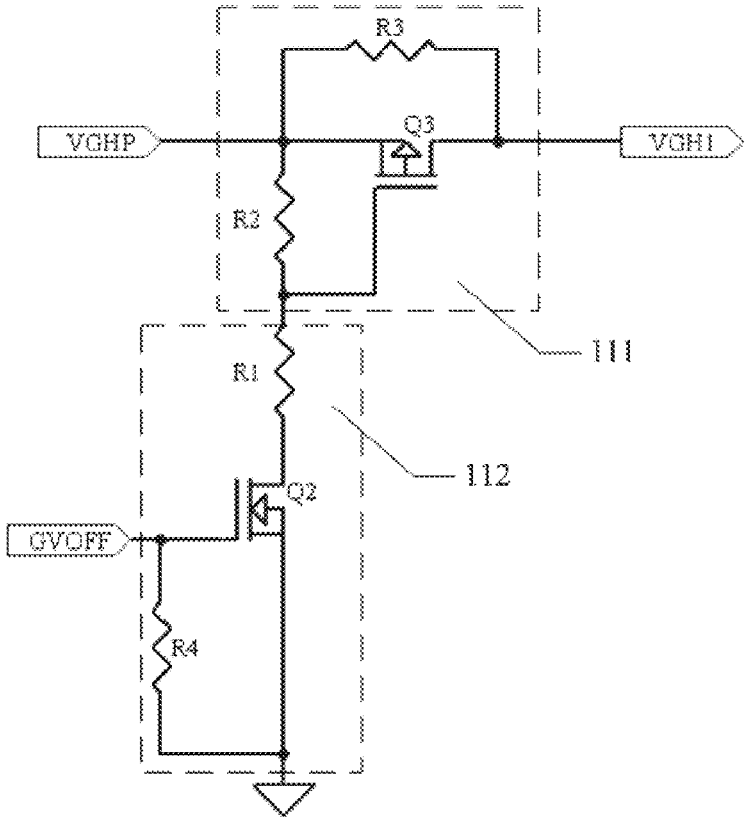
FIG. 4 is a circuit diagram of the charging module (equipped with a pull-down resistor) of the tangent angle circuit in the LCD driving system according to the present invention.

Referring to FIG. 2 to FIG. 4, FIG. 2 is a schematic structural view of the charging module of the tangent angle circuit in the LCD driving system shown in FIG. 1; FIG. 3 is a circuit diagram of the charging module of the tangent angle) circuit in the LCD driving system shown in FIG. 2; and FIG. 4 is a circuit diagram of the charging module, which is equipped with a pull-down resistor, of the tangent angle circuit in the LCD driving system shown in FIG. 3.

As shown in FIG. 2, the charging module 11 comprises:

a switch sub-module 111, being configured to receive the input of the DC driving voltage and output the cut-in voltage to charge the scan line driving circuits 30; and a switch control sub-module 112, being configured to control the switch sub-module 111 to turn on or turn off so as to control a charging time of the scan line driving circuits.

In this embodiment, when the switch control sub-module 112 controls the switch sub-module 111 to turn on, the switch sub-module 111 outputs the cut-in voltage that has a same amplitude as the DC driving voltage to charge the scan line driving circuits 30; and when the switch control sub-module 112 controls the switch sub-module 111 to turn off, no cut-in voltage is available to charge the scan line driving circuits 30. In this case, when the discharging module 12 turns on, the corresponding scan line driving circuit 30 discharges through the discharging module 12, and a tangent-angle slope of the discharge voltage is related to the resistance of a discharge resistor of the discharging module 12. In this embodiment, by controlling the switch sub-module 111 to turn on or turn off, charging of the scan line driving circuit 30 by the cut-in voltage is controlled; and a time interval between the turning on and the subsequent turning off of the switch sub-module 111 is called a charging time of the cut-in voltage. Furthermore, both the switch sub-module 111 and the switch control sub-module 112 are installed on the control board 20; and the discharging module 12 is installed on the scan line driving circuit 30 separately from the charging module 11 so as to release space for installation of the switch sub-module 111 and the switch control sub-module 112. This prevents) components of the switch sub-module 111 and the switch control sub-module 112 from being arranged densely, which is favorable for heat dissipation and for saving the area of the control board 20.

As shown in FIG. 3, the switch control sub-module 112 comprises a second MOS transistor Q2, and the switch sub-module 111 comprises a third MOS transistor Q3. The second MOS transistor Q2 has a source that is grounded, a gate for receiving a second control signal GVOFF that controls the second MOS transistor Q2 to turn on or turn off, and a drain connected to a gate of the third MOS transistor Q3 via a first resistor R1 to control the third MOS transistor Q3 to turn on or turn off. A source of the third MOS transistor Q3 receives the DC driving voltage VGHP. The DC driving voltage VGHP is inputted to the gate of the third MOS transistor Q3 via a second resistor R2 and is also inputted to a drain of the third MOS transistor Q3 via a third resistor R3. The drain of the third MOS transistor Q3 outputs the cut-in voltage VGH1 having a constant value to charge the scan line driving circuits 30.

In this embodiment, the second MOS transistor Q2 is an N-channel MOS transistor; the third MOS transistor Q3 is a P-channel MOS transistor; the second control signal GVOFF is a square wave; and the DC driving voltage VGHP is a DC voltage having a constant amplitude. When the second control signal GVOFF is at a high level, the gate voltage of the second MOS transistor Q2 is higher than a source voltage thereof, so the second MOS transistor Q2 is turned on. For the third MOS transistor Q3, the gate thereof is grounded via the first resistor R1 and the source thereof receives the DC driving voltage VGHP, so the third MOS transistor Q3 is also turned on because the gate voltage is lower than the source voltage. Then, the DC driving voltage VGHP is outputted via the source and the drain of the third MOS transistor Q3 as the cut-in voltage VGH1. The cut-in voltage VGH1 is used to charge the scan line driving circuits 30 and has the same amplitude as the DC driving voltage VGHP. On the other hand, when the second control signal GVOFF is at a low level, both the gate voltage and the source voltage of the second MOS transistor Q2 are zero, so the second MOS transistor Q2 is turned off and the third MOS transistor Q3 is also turned off. Then, output of the DC driving voltage VGHP to a load is stopped; i.e., the cut-in voltage VGH1 stops charging the scan line driving circuits 30. In this case, when the discharging module 12 is turned on, the corresponding scan line driving circuit 30 discharges through the discharging module 12, and the amplitude of the discharge voltage of the scan line driving circuit 30 is reduced. Consequently, the waveform of the discharge voltage VGH2 has a slope which is related to the resistance of the discharge resistor of the discharging module 12. In this embodiment, by using the MOS transistors as switch components and by controlling turning-on or -off of the second MOS transistor Q2 and the third MOS transistor Q3 through use of the second control signal GVOFF, the charging time for the cut-in voltage VGH1 to charge the scan line driving circuits 30 is controlled. A time interval between the turning on and the subsequent turning off of the second MOS transistor Q2 and the third MOS transistor Q3 is called the charging time, which is equal to a duration of the high level of the second control signal GVOFF. Furthermore, the second MOS transistor Q2, the third MOS transistor Q3, the first resistor R1, the second resistor R2 and the third resistor R3 are all installed on the control board 20; and the discharging modules 12 are installed on the scan line driving circuits 30. Because this releases space for installation of components of the charging module 11, dense arrangement of the components of the charging module 11 is prevented, which is favorable for heat dissipation and for reducing the area of the control board 20.

As shown in FIG. 4, the switch control sub-module 112 further comprises a pull-down resistor R4, and the gate of the second MOS transistor Q2 is grounded via the pull-down resistor R4.

In this embodiment, when the second control signal GVOFF is at a low level, the gate of the second MOS transistor Q2 is rapidly grounded via the pull-down resistor R4 so that the gate voltage of the second MOS transistor Q2 is rapidly reduced to zero. This increases the turning-off speed of the second MOS transistor Q2 and shortens the response time for the cut-in voltage VGH1 to stop charging the scan line driving circuits 30, which is favorable for discharging of the scan line driving circuits 30.

Figure 5:
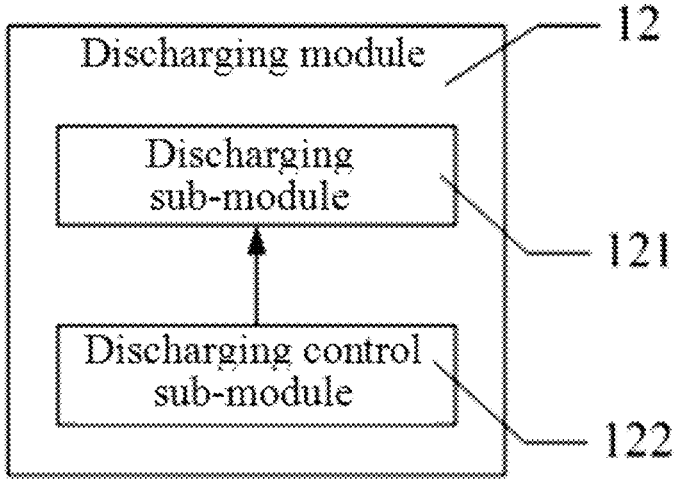
FIG. 5 is a schematic structural view of one of discharging modules of the tangent angle circuit in the LCD driving system according to the present invention.
Figure 6:
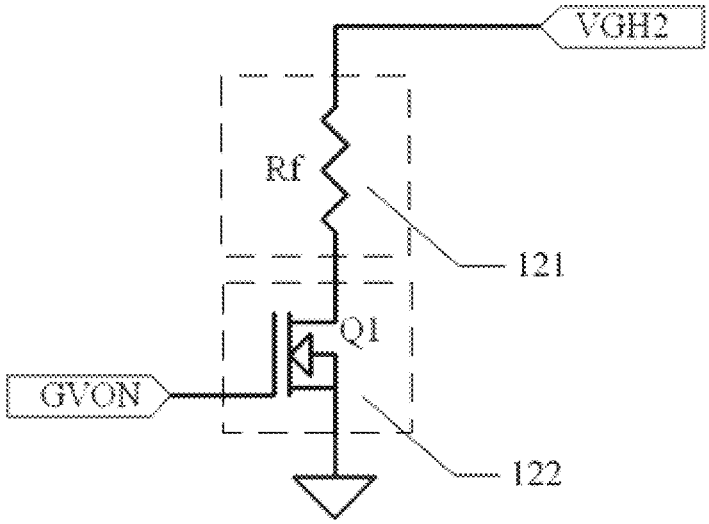
FIG. 6 is a circuit diagram of the discharging module of the tangent angle circuit in the LCD driving system according to the present invention.
Figure 7:
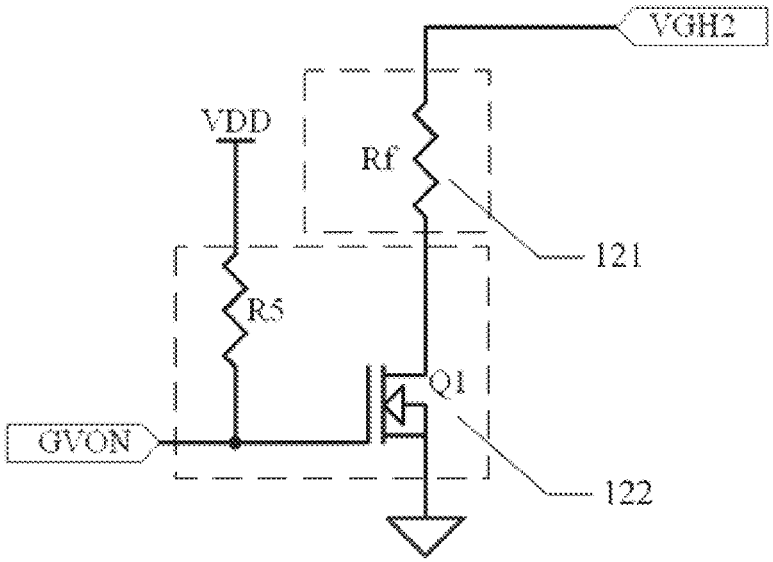
FIG. 7 is a circuit diagram of the discharging module (equipped with a pull-up resistor) of the tangent angle circuit in the LCD driving system according to the present invention.

Referring to FIG. 5 to FIG. 7, FIG. 5 is a schematic structural view of one of the discharging modules of the tangent angle circuit in the LCD driving system shown in FIG. 1; FIG. 6 is a circuit diagram of the discharging module of the tangent angle circuit in the LCD driving system shown in FIG. 5; and FIG. 7 is a circuit diagram of the discharging module, which is equipped with a pull-up resistor, of the tangent angle circuit in the LCD driving system shown in FIG. 6.

As shown in FIG. 5, the discharging module 12 comprises:

a discharging control sub-module 122, being configured to control the discharging module 12 to turn on or turn off so as to control a corresponding one of the scan line driving circuits 30 to discharge; and a discharging sub-module 121, being configured to receive the discharge voltage VGH2 of the corresponding scan line driving circuit 30 and control a discharging rate of the discharge voltage VGH2.

In this embodiment, when the discharging control sub-module 122 controls the discharging module 12 to turn on, the scan line driving circuit 30 discharges through the discharging sub-module 121. A tangent-angle slope of the discharge voltage is related to the resistance of the discharge resistor of the discharging sub-module 121. When the discharging control sub-module 122 controls the discharging module 12 to turn off, the scan line driving circuit 30 stops discharging. In this embodiment, a time interval between the turning on and the subsequent turning off of the discharging module 12 is called a discharging duration of the scan line driving circuit 30. Furthermore, both the discharging sub-module 121 and the discharging control sub-module 122 are installed on the scan line driving circuit 30 separately from the charging module 11 to release space for installation of the charging module 11. This prevents components of the charging module 11 to be arranged densely, which is favorable for heat dissipation and for reducing the area of the control board 20. Meanwhile, each of the scan line driving circuits 30 is provided with a respective discharging sub-module 121 and a respective discharging control sub-module 122 thereon, so the discharging modules 12 are separated from each other, which is further favorable for heat dissipation. Furthermore, it is also possible to install a discharging control sub-module 122 on the control board 20 and then install only the discharging sub-modules 121 on the scan line driving circuits 30, with a control end of each of the discharging sub-modules 121 being connected to the discharging control sub-module 122. In this way, turning-on or -off of discharging paths on the plurality of scan line driving circuits 30 are simultaneously controlled by one discharging control sub-module 122, which can reduce the number of discharging control sub-modules 122 and save space for the scan line driving circuits 30.

As shown in FIG. 6, the discharging control sub-module 122 comprises a first MOS transistor Q1, and the discharging sub-module 121 comprises a discharge resistor Rf. The first MOS transistor Q1 has a gate for receiving a first control signal GVON that controls the first MOS transistor Q1 to turn on or turn off, a source that is grounded, and a drain for receiving the discharge voltage VGH2 via the discharge resistor Rf.

In this embodiment, the first MOS transistor Q1 is an N-channel MOS transistor, and the first control signal GVON is a square wave. When the first control signal GVON is at a high level, the gate voltage of the first MOS transistor Q1 is higher than the source voltage, so the first MOS transistor Q1 is turned on and the scan line driving circuit 30 discharges through the discharge resistor Rf. The discharge capacity is related to the resistance of the discharge resistor Rf. Conversely, when the first control signal GVON is at a low level, both the gate voltage and the source voltage of the first MOS transistor Q1 are zero, so the first MOS transistor Q1 is turned off and the scan line driving circuit 30 stops discharging. In this embodiment, by controlling the first MOS transistor Q1 to turn on or turn off through use of the first control signal GVON, the discharging time of the scan line driving circuit 30 is controlled. A time interval between the turning on and the subsequent turning off of the first MOS transistor Q1 is called the discharging time (i.e., a duration in which the waveform of the discharge voltage VGH2 has a tangent-angle slope), which is equal to a duration in which the first control signal GVON is at the high level. Furthermore, both the first MOS transistor Q1 and the discharge resistor Rf are installed on the scan line driving circuit 30; and this releases space for installation of components of the charging module 11 and prevents the components of the charging module 11 from being arranged densely, which is favorable for heat dissipation and for reducing the area of the control board 20. Meanwhile, each of the scan line driving circuits 30 is provided with a respective first MOS transistor Q1 and a respective discharge resistor Rf disposed thereon, so the discharging modules 12 are separated from each other, which is further favorable for heat dissipation. Furthermore, it is also possible to install a first MOS transistor Q1 on the control board 20 and install only the discharge resistors Rf on the scan line driving circuits 30, with the discharge resistors Rf being connected in parallel to the drain of the first MOS transistor Q1. In this way, turning-on or -off of discharging paths on the plurality of scan line driving circuits 30 are simultaneously controlled by one first MOS transistor Q1, which can reduce the number of first MOS transistors Q1 and save space for the scan line driving circuits 30.

As shown in FIG. 7, the discharging control sub-module 122 further comprises a pull-up resistor R5, and the gate of the first MOS transistor Q1 is connected to a power source VDD via the pull-up resistor R5.

In this embodiment, when the first control signal GVON is at a high level, the gate of the first MOS transistor Q1 is rapidly pulled up via the pull-up resistor R5 so that the gate voltage of the first MOS transistor Q1 is rapidly increased to be higher than the source voltage thereof. This increases the turning-on speed of the first MOS transistor Q1 and shortens the response time for the scan line driving circuits 30 to discharge, which facilitates formation of a tangent angle. Furthermore, there may be only one pull-up resistor R5 which is installed on the control board 20 and the gates of the first MOS transistors Q1 are all connected in parallel to the same pull-up resistor R5, which can reduce the number of components and the space occupied on the scan line driving circuits 30. Alternatively, there may be a plurality of pull-up resistors R5, and the pull-up resistors R5 are integrated on the scan line driving circuits 30 respectively and are connected to the gates of the corresponding first MOS transistors Q1, which can reduce the space occupied on the control board 20.

Figure 8:
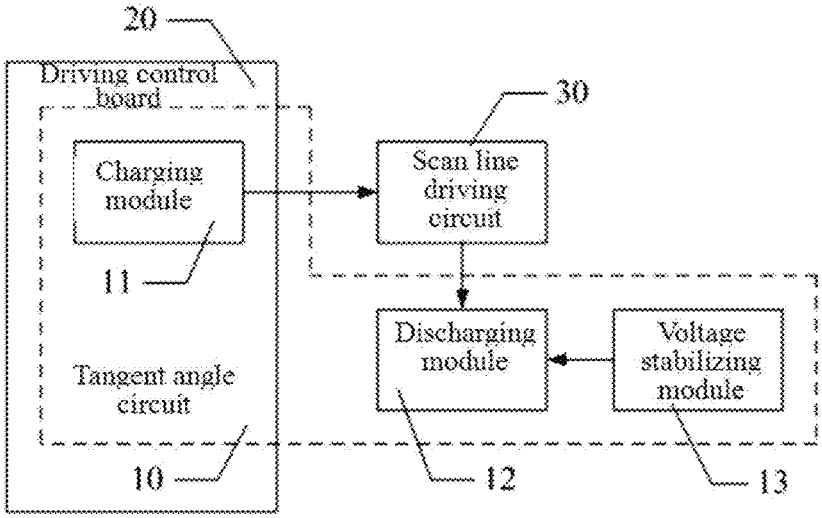
FIG. 8 is a schematic structural view of the tangent angle circuit (equipped with a voltage stabilizing module) in the LCD driving system according to the present invention.
Figure 9:
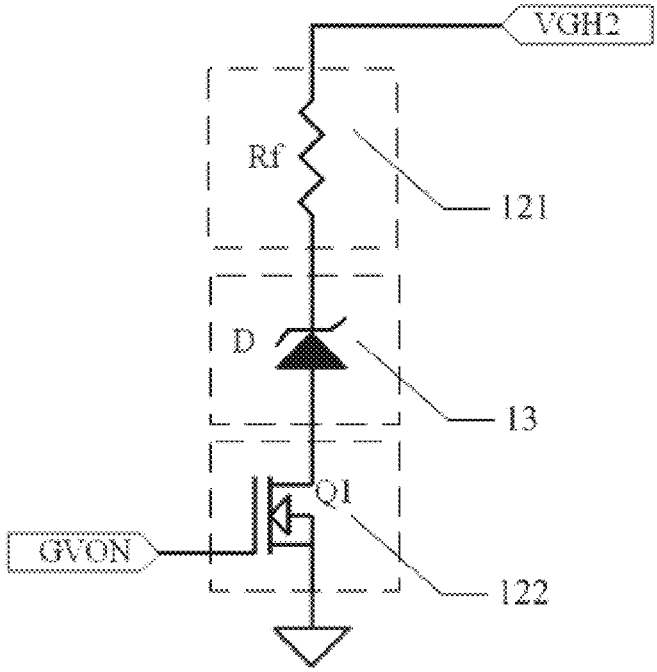
FIG. 9 is a circuit diagram of the discharging module (connected to the voltage stabilizing module) of the tangent angle circuit in the LCD driving system according to the present invention.

Referring to FIG. 8 and FIG. 9, FIG. 8 is a schematic structural view of the tangent angle circuit, which is equipped with a voltage stabilizing module, in the LCD driving system shown in FIG. 1; and FIG. 9 is a circuit diagram of the discharging module, which is connected to the voltage stabilizing module, of the tangent angle circuit in the LCD driving system shown in FIG. 8.

As shown in FIG. 8, the tangent angle circuit 10 further comprises:

a voltage stabilizing module 13, being connected to the discharging modules 12 and configured to control a discharge lower limit of the scan line driving circuits 30.

In this embodiment, by using the voltage stabilizing module 13 to control a voltage value at the lowest point of the discharge tangent-angle waveform of the discharge voltage, the slope of the discharge tangent-angle waveform of the discharge voltage can be regulated according to actual requirements to further reduce the feedback voltage and the linear variation effect. It is possible that the voltage stabilizing module 13 is integrated on the control board 20 and only one voltage stabilizing module 13 is used to control a lower limit of the discharge voltage of each of the discharging modules 12 simultaneously, which can reduce the number of voltage stabilizing modules 13. Alternatively, the voltage stabilizing modules 13 may be integrated on the scan line driving circuits 30 respectively with each voltage stabilizing module 13 corresponding to one discharging module 12, which can reduce space occupied on the control board 20.

As shown in FIG. 9, the voltage stabilizing module 13 comprises a voltage-regulator diode D connected in series with the discharge resistor Rf. The voltage-regulator diode D has a positive electrode connected to the drain of the first MOS transistor Q1 and a negative electrode for receiving the discharge voltage VGH2 via the discharge resistor Rf.

In this embodiment, by using the voltage-regulator diode D to control a voltage value at the lowest point of the discharge tangent-angle waveform of the discharge voltage VGH2, the slope of the discharge tangent-angle waveform of the discharge voltage VGH2 can be regulated according to actual requirements to further reduce the feedback voltage and the linear variation effect. It is possible that the voltage-regulator diode D is installed on the control board 20 and connected in series with the discharge resistors Rf that are connected in parallel; and only one voltage-regulator diode D is used to regulate a lower limit of the discharge voltage VGH2 of each of the scan line driving circuits 30 simultaneously, which can reduce the number of voltage-regulator diode D. Alternatively, the voltage-regulator diode D may be installed on the scan line driving circuits 30 with each voltage-regulator diode D being connected in series with one discharge resistor Rf, which can reduce space occupied on the control board 20.

Figure 10:
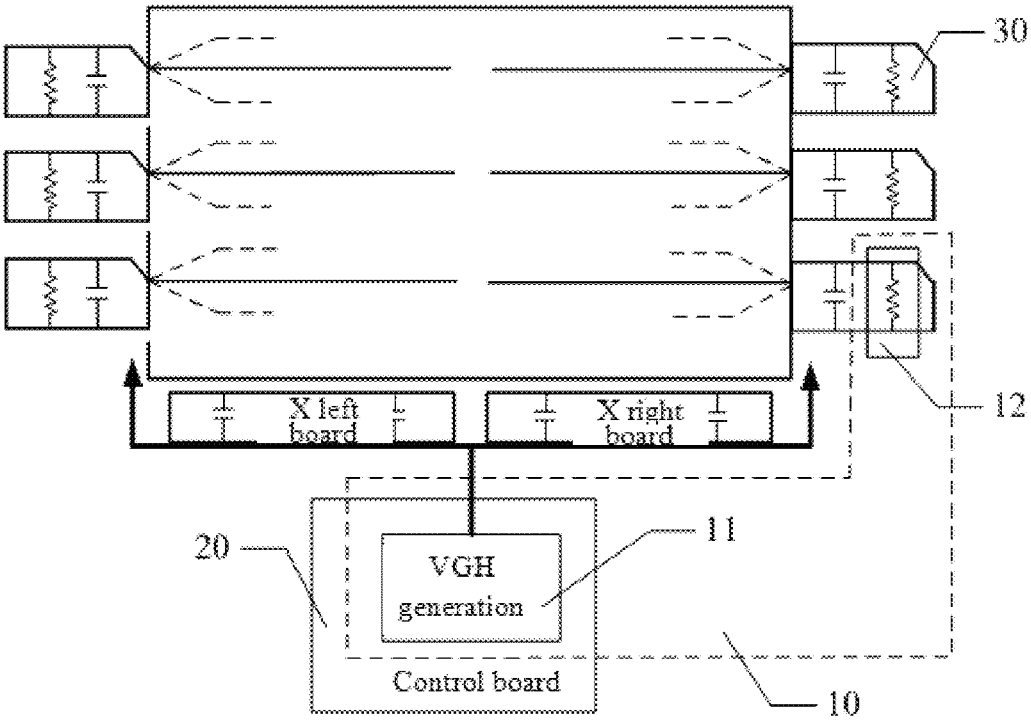
FIG. 10 is a schematic structural view of the LCD driving system (equipped with a tangent angle circuit) according to the present invention.

As shown in FIG. 10, there is shown a schematic structural view of the LCD driving system (equipped with a tangent angle circuit) according to the present invention. In this embodiment, the LCD driving system comprises a control board 20, scan line driving circuits 30 and a tangent angle circuit 10. The tangent angle circuit 10 comprises a charging module 11 integrated on the control board 20 and a plurality of discharging modules 12 integrated on the scan line driving circuits 30 respectively.

In this embodiment, a cut-in voltage generated by the charging module 11 integrated on the control board 20 is transferred to the scan line driving circuits 30 at both sides respectively to charge the scan line driving circuits 30. After the charging process is completed, the scan line driving circuits 30 discharge through the discharging modules 12 so as to reduce the feedback voltage and the linear variation effect. In this embodiment, the discharging modules 12 are distributed on the scan line driving circuits 30 in one-to-one correspondence so that, when the scan line driving circuits 30 discharge, each of the discharging modules 12 only needs to discharge load charges of the corresponding scan line driving circuit 30. This can avoid the problem of an overhigh temperature that would occur when the discharging module 12 has to discharge all the load discharged charges, and significantly improve the problem of the overhigh temperature in case of a large-size panel or a high updating frequency. Furthermore, the discharging modules 12 are distributed on the scan lines respectively and are spatially separated, so congestion of components and occupation of space on the control board 20 are avoided, which is further favorable for reducing the temperature, releasing the space of the control board 20 and reducing the area of the control board 20.

What described above are only preferred embodiments of the present invention but are not intended to limit the scope of the present invention. Accordingly, any equivalent structural or process flow modifications that are made on basis of the specification and the attached drawings or any direct or indirect applications in other technical fields shall also fall within the scope of the present invention.

The invention claimed is:

1. A tangent angle circuit in a liquid crystal display (LCD) driving system, being connected to a plurality of scan line driving circuits, the tangent angle circuit comprising:

a charging module, being integrated on a control board and configured to receive input of a direct current (DC) driving voltage and output a cut-in voltage to charge the scan line driving circuits, the charging module comprising:

a switch sub-module, being configured to receive the input of the DC driving voltage and output the cut-in voltage to charge the scan line driving circuits; and a switch control sub-module, being configured to control the switch sub-module to turn on or turn off so as to control a charging time of the scan line driving circuits; and a plurality of discharging modules, being integrated on the scan line driving circuits respectively and configured to control the corresponding scan line driving circuits to discharge, each of the discharging modules comprising:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharge in rate of the discharge voltage;

wherein the discharging control sub-module comprises a first metal-oxide-semiconductor (MOS) transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor;

wherein the switch control sub-module comprises a second MOS transistor, the switch sub-module comprises a third MOS transistor, the second MOS transistor has a source that is grounded, a gate for receiving a second control signal that controls the second MOS transistor to turn on or turn off, and a drain connected to a gate of the third MOS transistor via a first resistor to control the third MOS transistor to turn on or turn off; a source of the third MOS transistor receives the input of the DC driving voltage, the DC driving voltage is inputted to the gate of the third MOS transistor via a second resistor and is also inputted to a drain of the third MOS transistor via a third resistor, and the drain of the third MOS transistor outputs the cut-in voltage to charge the scan line driving circuits.

2. The tangent angle circuit in an LCD driving system of claim 1, wherein the discharging control sub-module further comprises a pull-up resistor, and the gate of the first MOS transistor is connected to a power source via the pull-up resistor.

3. The tangent angle circuit in an LCD driving system of claim 1, wherein the switch control sub-module further comprises a pull-down resistor, and the gate of the second MOS transistor is grounded via the pull-down resistor.

4. The tangent angle circuit in an LCD driving system of claim 1, wherein the second control signal and the first control signal are high-/low-level square waves having a same period but opposite amplitudes.

5. A tangent angle circuit in an LCD driving system, being connected to a plurality of scan line driving circuits, the tangent angle circuit comprising:

a charging module, being integrated on a control board and configured to receive input of a DC driving voltage and output a cut-in voltage to charge the scan line driving circuits; the charging module comprising:

a switch sub-module, being configured to receive the input of the DC driving voltage and output the cut-in voltage to charge the scan line driving circuits; and a switch control sub-module, being configured to control the switch sub-module to turn on or turn off so as to control a charging time of the scan line driving circuits;

a plurality of discharging modules, being integrated on the scan line driving circuits respectively and configured to control the corresponding scan line driving circuits to discharge; and a voltage stabilizing module, being connected to the discharging modules and configured to control a discharge lower limit of the scan line driving circuits;

wherein the switch control sub-module comprises a second MOS transistor, the switch sub-module comprises a third MOS transistor, the second MOS transistor has a source that is grounded, a gate for receiving a second control signal that controls the second MOS transistor to turn on or turn off, and a drain connected to a gate of the third MOS transistor via a first resistor to control the third MOS transistor to turn on or turn off; a source of the third MOS transistor receives the input of the DC driving voltage, the DC driving voltage is inputted to the gate of the third MOS transistor via a second resistor and is also inputted to a drain of the third MOS transistor via a third resistor, and the drain of the third MOS transistor outputs the cut-in voltage to charge the scan line driving circuits.

6. The tangent angle circuit in an LCD driving system of claim 5, wherein each of the discharging modules comprises:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharging rate of the discharge voltage.

7. The tangent angle circuit in an LCD driving system of claim 6, wherein the discharging control sub-module comprises a first MOS transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor.

8. The tangent angle circuit in an LCD driving system of claim 7, wherein the discharging control sub-module further comprises a pull-up resistor, and the gate of the first MOS transistor is connected to a power source via the pull-up resistor.

9. The tangent angle circuit in an LCD driving system of claim 8, wherein the voltage stabilizing module comprises a voltage-regulator connected in series with the discharge resistor, and the voltage-regulator has a positive electrode connected to the drain of the first MOS transistor and a negative electrode for receiving the input of the discharge voltage via the discharge resistor.

10. An LCD driving system, comprising a control board and a plurality of scan line driving circuits, the LCD driving system further comprising:

a tangent angle circuit, comprising:

a charging module, being integrated on the control board and configured to receive input of a DC driving voltage and output a cut-in voltage to charge the scan line driving circuits, the charging module comprising:

a switch sub-module, being configured to receive the input of the DC driving voltage and output the cut-in voltage to charge the scan line driving circuits; and a switch control sub-module, being configured to control the switch sub-module to turn on or turn off so as to control a charging time of the scan line driving circuits; and a plurality of discharging modules, being integrated on the scan line driving circuits respectively and configured to control the corresponding scan line driving circuits to discharge; each of the discharging modules comprising:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharge in rate of the discharge voltage;

wherein the discharging control sub-module comprises a first MOS transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor; and wherein the switch control sub-module comprises a second MOS transistor, the switch sub-module comprises a third MOS transistor, the second MOS transistor has a source that is grounded, a gate for receiving a second control signal that controls the second MOS transistor to turn on or turn off of, and a drain connected to a gate of the third MOS transistor via a first resistor to control the third MOS transistor to turn on or turn off; a source of the third MOS transistor receives the input of the DC driving voltage, the DC driving voltage is inputted to the gate of the third MOS transistor via a second resistor and is also inputted to a drain of the third MOS transistor via a third resistor, and the drain of the third MOS transistor outputs the cut-in voltage to charge the scan line driving circuits.

11. The LCD driving system of claim 10, wherein the discharging control sub-module further comprises a pull-up resistor, and the gate of the first MOS transistor is connected to a power source via the pull-up resistor.

12. The LCD driving system of claim 10, wherein the switch control sub-module further comprises a pull-down resistor, and the gate of the second MOS transistor is grounded via the pull-down resistor.

13. An LCD driving system, comprising a control board and a plurality of scan line driving circuits, the LCD driving system further comprising:

a tangent angle circuit, comprising:

a charging module, being integrated on the control board and configured to receive input of a DC driving voltage and output a cut-in voltage to charge the scan line driving circuits, the charging module comprising:

a switch sub-module, being configured to receive the input of the DC driving voltage and output the cut-in voltage to charge the scan line driving circuits; and a switch control sub-module, being configured to control the switch sub-module to turn on or turn off so as to control a charging time of the scan line driving circuits; and a plurality of discharging modules, being integrated on the scan line driving circuits respectively and configured to control the corresponding scan line driving circuits to discharge;

wherein the switch control sub-module comprises a second MOS transistor, the switch sub-module comprises a third MOS transistor, the second MOS transistor has a source that is grounded, a gate for receiving a second control signal that controls the second MOS transistor to turn on or turn off, and a drain connected to a gate of the third MOS transistor via a first resistor to control the third MOS transistor to turn on or turn off; a source of the third MOS transistor receives the input of the DC driving voltage, the DC driving voltage is inputted to the gate of the third MOS transistor via a second resistor and is also inputted to a drain of the third MOS transistor via a third resistor, and the drain of the third MOS transistor outputs the cut-in voltage to charge the scan line driving circuits.

14. The LCD driving system of claim 13, wherein each of the discharging modules comprises:

a discharging control sub-module, being configured to control the discharging module to turn on or turn off so as to control a corresponding one of the scan line driving circuits to discharge; and a discharging sub-module, being configured to receive a discharge voltage of the corresponding scan line driving circuit and control a discharging rate of the discharge voltage.

15. The LCD driving system of claim 14, wherein the discharging control sub-module comprises a first metal-oxide-semiconductor (MOS) transistor, the discharging sub-module comprises a discharge resistor, and the first MOS transistor has a gate for receiving a first control signal that controls the first MOS transistor to turn on or turn off, a source that is grounded, and a drain for receiving input of the discharge voltage via the discharge resistor.

16. The LCD driving system of claim 15, wherein the discharging control sub-module further comprises a pull-up resistor, and the gate of the first MOS transistor is connected to a power source via the pull-up resistor.

17. The LCD driving system of claim 13, wherein the switch control sub-module further comprises a pull-down resistor, and the gate of the second MOS transistor is grounded via the pull-down resistor.

18. The LCD driving system of claim 13, wherein the second control signal and the first control signal are high-/low-level square waves having a same period but opposite amplitudes.

* * * * *